US005691893A

United States Patent [19]

Stothers

[11] Patent Number: 5,691,893

[45] Date of Patent: Nov. 25, 1997

[54] ADAPTIVE CONTROL SYSTEM

[75] Inventor: Ian MacGregor Stothers, Norfolk, United Kingdom

[73] Assignee: Lotus Cars Limited, Norfolk, United Kingdom

[21] Appl. No.: 416,765

[22] PCT Filed: Oct. 21, 1993

[86] PCT No.: PCT/GB93/02171

§ 371 Date: Jun. 2, 1995

§ 102(e) Date: Jun. 2, 1995

[87] PCT Pub. No.: WO94/09482

PCT Pub. Date: Apr. 28, 1994

[30] Foreign Application Priority Data

Oct. 21, 1992 [GB] United Kingdom ..... 9222104

[51] Int. Cl.[6] ..... G05B 13/02

[52] U.S. Cl. ..... 364/148; 381/71; 381/93; 370/32.1; 379/406; 379/409

[58] Field of Search ..... 364/148, 300, 364/900, 572, 574; 381/71, 94; 379/388, 390, 410

[56] References Cited

U.S. PATENT DOCUMENTS

| | | | |
|---|---|---|---|
| 4,122,303 | 10/1978 | Chaplin et al. | 381/71 |
| 4,153,815 | 5/1979 | Chaplin et al. | 381/71 |
| 4,172,235 | 10/1979 | Jones, Jr. | 324/249 |
| 4,360,712 | 11/1982 | Horna | 379/406 |
| 4,490,841 | 12/1984 | Chaplin et al. | 381/71 |
| 4,493,101 | 1/1985 | Muraoka et al. | 381/93 |
| 4,596,033 | 6/1986 | Swinbanks | 381/71 |
| 4,677,677 | 6/1987 | Eriksson | 381/71 |
| 4,683,590 | 7/1987 | Miyoshi et al. | 381/71 |
| 4,689,821 | 8/1987 | Salikuddin et al. | 381/71 |
| 4,697,261 | 9/1987 | Wang et al. | 370/32.1 |
| 4,736,414 | 4/1988 | Montagna et al. | 379/411 |
| 4,815,139 | 3/1989 | Eriksson et al. | 381/71 |
| 4,894,820 | 1/1990 | Miyamoto et al. | 370/32.1 |
| 4,918,727 | 4/1990 | Rohrs et al. | 379/410 |
| 4,980,914 | 12/1990 | Kunugi et al. | 381/163 |
| 5,091,953 | 2/1992 | Tretter | 351/71 |

FOREIGN PATENT DOCUMENTS

| | | |
|---|---|---|
| 0 043 565 A1 | 1/1982 | European Pat. Off. . |
| 0 103 256 A1 | 3/1984 | European Pat. Off. . |
| 0 233 717 A3 | 8/1987 | European Pat. Off. . |
| 2 107 960 | 5/1983 | United Kingdom . |

OTHER PUBLICATIONS

*Academic Press*, "Active Control of Sound", by P.A. Nelson et al., 1992, pp. 113–115.

*Primary Examiner*—Reba I. Elmore
*Assistant Examiner*—McDieunel Marc
*Attorney, Agent, or Firm*—Westman, Champlin & Kelly, P.A.

[57] ABSTRACT

An adaptive control system for reducing undesired signals comprises a processor (36) which provides secondary signals for sources (37) for interference with the undesired signals. Sensors (42) measure the residual Vibration which is indicative of the interference between the undesired and secondary signals. The processor (36) uses the residual signal to adjust the secondary signals to reduce the residual signals. Noise generation means (48) is provided to add a low level noise signal to the secondary signal and to provide a low level noise signal to the processor (36). The processor (36) is adapted to transform the low level noise signal and the residual signal from sensors (42) to provide the amplitude and phase of spectral components of the signals. The processor (36) modifies the secondary signals using these spectral components to obtain better reduction of the undesired signals.

38 Claims, 8 Drawing Sheets

ADAPTIVE CONTROL SYSTEM

BACKGROUND OF THE INVENTION

The present invention relates to an adaptive control system and method for reducing undesired primary signals generated by a primary source of signals.

The basic principle of adaptive control is to monitor the primary signals and produce a cancelling signal which interferes destructively with the primary signals in order to reduce them. The degree of success in cancelling the primary signals is measured to adapt the cancelling signal to increase the reduction in the undesired primary signals.

This idea is thus applicable to any signals such as electrical signals within an electrical circuit in which undesired noise is produced. One particular area which uses such adaptive control is in the reduction of unwanted acoustic vibrations in a region.

It is to be understood that the term "acoustic vibration" applies to any acoustic vibration including sound.

There has been much work performed in this area with a view to providing a control system which can adapt quickly to changes in amplitude and frequency of vibrations from a primary source. Such a system is disclosed in WO88/02912. In this document a controller is disclosed which is implemented as a digital adaptive finite impulse response (FIR) filter. Such a filter adapts its coefficients based on the degree of success in cancelling the undesired vibrations. In order to be able to do so however it must be provided with a model of the acoustic response of the system, i.e. the response of the residual vibration sensors to the output from the secondary vibration sources. In the arrangement disclosed in WO88/02912, the acoustic response of the system is modelled by a matrix of transfer functions termed $\underline{C}$. This can either be a prestored model or the arrangement disclosed in WO88/02912 can adaptively modify the matrix entries denoting changes in the transfer functions due to changes in the acoustic properties within the enclosure in which noise cancellation is taking place. Such adaptive learning of the transfer functions is performed in the time domain.

It is therefore an object of the present invention to adaptively determine in the frequency domain the transfer functions between the drive signals generated to cancel the noise and the detected residual signals.

SUMMARY OF THE INVENTION

The present invention provides an adaptive control system for reducing undesired signals comprising a process or adapted to provide at least one secondary signal to interfere with the undesired signals; and a circuit to provide for said processor at least one residual signal indicative of the interference between said undesired and secondary signals; wherein said processor is adapted to use said at least one residual signal to adjust the or each secondary signal to reduce said at least one residual signal; characterized by a noise generator adapted to add at least one low level noise signal to the at least one secondary signal and provide the at least low level noise signal to the processor; said processor being adapted to transform the at least one low level noise signal and the at least one residual signal to provide the amplitude and phase of spectral components of the signals, and to modify the at least one secondary signal using said spectral components of said signals.

Preferably the system includes a circuit to provide at least one first signal indicative of at least selected undesired signals; the processor comprising an adaptive response filter having first filter coefficients to model the response of the at least one secondary signal to the at least one residual signal, and second filter coefficients adaptable in response to the at least one residual signal; the adaptive response filter being adapted to adjust the at least one secondary signal using the first and second filter coefficients to reduce the at least one residual signal.

Preferably at least one cross spectral estimate is formed by using the transforms of the said signals and said at least one cross spectral estimate is used to modify said first filter coefficients.

In one embodiment the processor is adapted to form said at least cross spectral estimate by multiplying the complex conjugate of the transform of said low level noise signal with a transform of said at least one residual signal.

In another embodiment of the present invention the processor is adapted to multiply said at least cross spectral estimate with a convergence coefficient sufficiently small to smooth out the effect of random errors in the cross spectral estimate on the modification of said first filter coefficients.

In one embodiment, where the compensation for the acoustic response of the system is performed in the frequency domain the first filter coefficients are complex and the processor is adapted to modify the complex first filter coefficients.

In another embodiment of the present invention where compensation for the response of the system takes place in the time domain, the processor is adapted to inverse transform said at least one cross spectral estimate to format least one cross correlation estimate and to modify said first filter coefficients using the at least one cross correlation estimate.

In such a time domain arrangement, either the cross spectral estimate can be multiplied with a convergence coefficient in the same manner as for the frequency domain system, or the at least one correlation estimate can be multiplied with a convergence coefficient sufficiently small to smooth out the effect of random errors in the cross correlation estimate on the modification of said first filter coefficients.

The modification of complex first filter coefficients is ideally suited for a control system which acts on the first signal in the time domain to produce the secondary signal in the time domain but for which the adaption of the second coefficients is performed in the frequency domain. In such a system according to one embodiment of the present invention the professor is adapted to transform said at least one first signal, to format least one second cross spectral estimate using the transform of the at least one first signal and the transform of the at least one residual signal, to inverse transform the at least one second cross spectral estimate to form at least one second cross correlation estimate, and to modify the second filter coefficients using the at least one second cross correlation estimate. In such a system the update of both the first and second filter coefficients is performed in the frequency domain.

In one embodiment of such a system which updates the second filter coefficients in the frequency domain, the processor is adapted to form at least one second cross spectral estimate by filtering the transform of the at least one first signal using the complex first filter coefficients and multiplying the complex conjugate of the result with the transform of the at least one residual signal.

In an alternative embodiment the processor is adapted to form at least one second cross spectral estimate by filtering the transform of the at least one residual signal using the complex conjugate of the complex first filter coefficients and multiplying the result with the complex first filter coefficients and multiplying the result with the complex conjugate of the transform of the at least one first signal.

Where the adaptive control system is for reducing selected signals of the undesired signals, the processor of the control system is preferably adapted to only modify the first filter coefficients which do not adjust the at least one secondary signal at the frequency of said selected signals.

In embodiments of the present invention the noise generator can either be adapted to generate random or pseudo-random noise or noise uncorrelated at least with selected signals.

In a further embodiment of the present invention said processor is adapted to modify at least one of the amplitude and phase of the spectral components of the noise signal, end to inverse transform the modified spectral component for addition to the at least one secondary signal. This allows for the signal to noise ratio of the noise component of the secondary signals to be kept below the ambient noise within the system.

In order for a transform of the noise signal and the at least one secondary signal to be possible, a number of data points in a window length for data block must be provided. A suitable transform to obtain the spectral components would be the Fourier transform and most conveniently the discrete fast Fourier transform. Such a discrete fast Fourier transform provides good control if the length of the window (or number of data points is long) this provides a long delay in the update. A short window of data on the other hand provides for a quick adaption but poor control.

In order to overcome the problems with the sampling of the data and the delays associated with the transmission of a signal through the adaptive response filter when the signal is acted upon by the first filter coefficients, the processor is preferably adapted to digitally sample the noise signal and the at least residual signal, and to store a plurality of digits for each signal to form noise signal and residual signal data blocks respectively, the noise signal data blocks and the residual signal data blocks being time aligned; the processor being further adapted to set a number of set digits at the end of each noise signal data block to zero to form a modified noise signal data block, and to transform the modified noise signal data block and the time associated residual signal data block to provide the amplitude and phase of the spectral components of the digitally sampled signals.

Preferably the number of digits at the end of each modified noise signal data block set to zero is set in dependence on the delay between the noise signal and the contribution from the noise signal in the residual signal. The number of digits set to zero is more preferably such that the time taken to sample said number is greater than the delay between a secondary signal and the contribution of the secondary signal in any residual signal.

In one embodiment wherein the undesired signals are undesired acoustic vibrations, take system including at least one secondary vibration source adapted to receive the at least one secondary signal and generate secondary vibrations to interfere with the undesired vibration; the circuit providing the residual signal comprising at least one sensor adapted to sense the residual vibrations resulting from the interference between the secondary and undesired vibrations, and to provide said at least one residual signal.

The present invention also provides a method of actively reducing undesired signals comprising the steps of providing at least one secondary signal which interferes with said undesired signals; providing at least one residual signal indicative of the interference between said undesired and secondary signals; and adjusting the secondary signal using the at least one residual signal to reduce the residual signal; generating at least one low level noise signal; adding the at least one noise signal to the at least one secondary signal; transforming the one noise signal and the at least one residual signal to provide the amplitude and phase of spectral components of the signals; and modifying the at least one secondary signal using the spectral components of the signals.

DETAILED DESCRIPTION OF THE PREFERRED EMBODIMENTS

Figure 1:
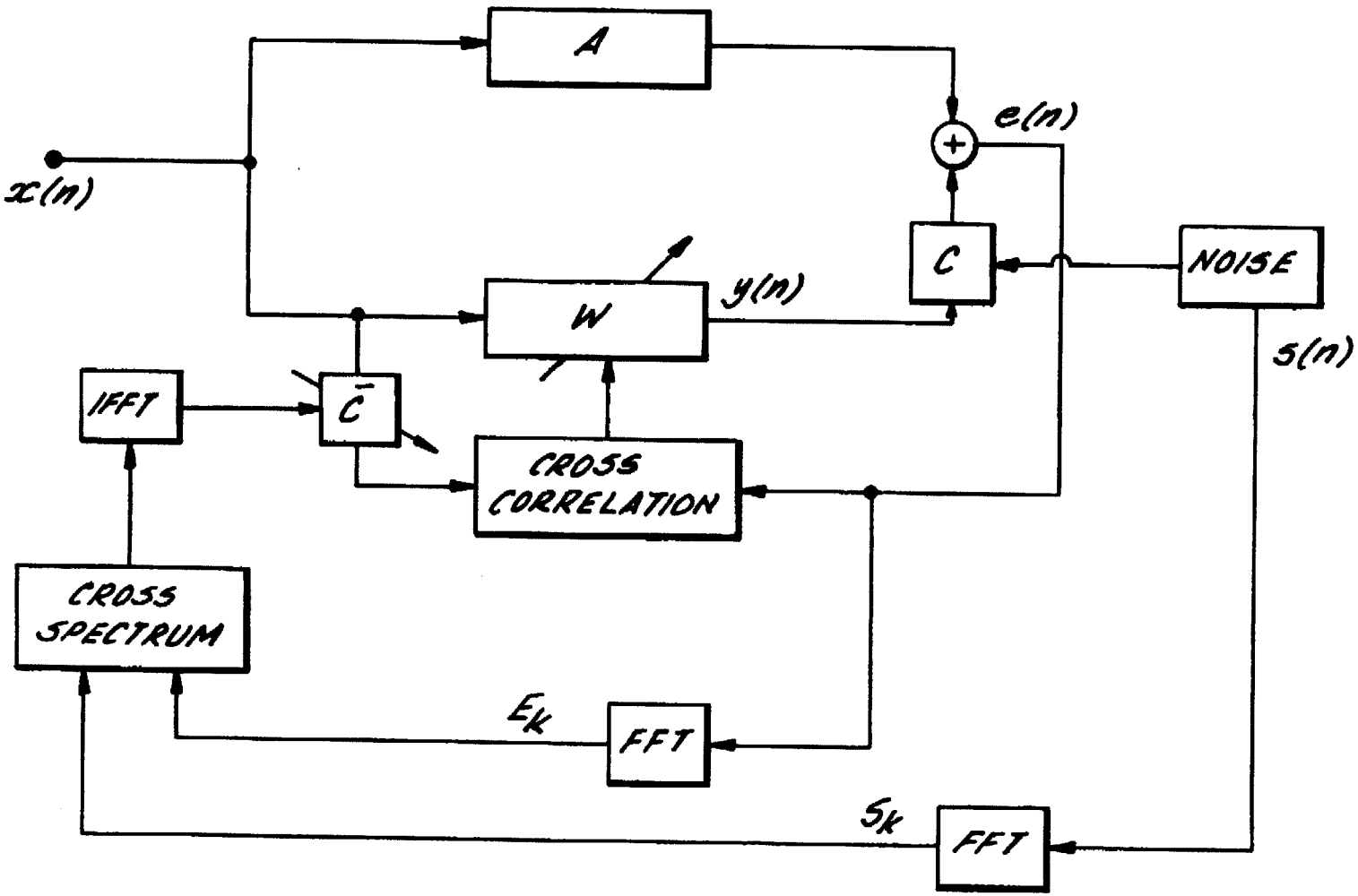
FIG. 1 illustrates schematically an adaptive control system wherein the transfer functions of an acoustic system are adapted in the frequency domain and the adaptive noise cancellation takes place in the time domain.

Referring now to the drawings, FIG. 1 illustrates the operation of an active vibration control system wherein the drive signal and the update of the adaptive filter coefficients to adapt the drive signal takes place in the time domain. FIG. 1 illustrates a single channel system having a single reference signal x(n), a single secondary vibration source receiving a single drive signal y(n) and a single error sensor providing a single error signal e(n). The reference signal x(n) represents primary vibrations from a primary source of vibrations. A represents the acoustic path from the primary source of vibrations to the acoustic area in which noise cancellation is to take place, The reference signal x(n) is input into an adaptive response filter w to produce a drive signal y(n) for output to a secondary vibration source. The vibrations produced by the secondary vibration source interfere with the primary vibrations and the interference is detected by a sensor to produce an error signal e(n). This provides a measure of the residual vibrations and hence the degree of success in cancelling the primary vibrations. This error signal e(n) can then be used to adapt the filter. coefficients of the w filter to modify the drive signal y(n) in order to achieve better cancellation.

During the update of the w filter coefficients reference signal x(n) is passed through a matrix $\underline{C}$ of impulse response functions which model the acoustic response of the sensor to the drive signal y(n). The filtered reference signal and the error signal are then used to form a cross correlation estimate. The cross correlation estimate is then used to modify the w filter coefficients. In order to reduce the effect of random fluctuations in the cross correlation estimate, the cross correlation estimate is multiplied by a convergence coefficient. This should be sufficiently small to reduce the effect of random fluctuations in the cross correlation estimate but not too small so as to prohibitively increase the convergence time.

Thus for a multichannel system with m secondary vibration sources and l sensors, the coefficients of the adaptive response filter w should be adjusted at every sample in the time domain according to the following equation:

$$\underline{w}_{ms}(n+1) = \underline{w}_{ms}(n) + \mu \sum_{i=1}^{L} e_l(n) r_{lm}(n-i)$$

where μ is a convergence coefficient $e_l(n)$ is the sampled output from the $l^{th}$ sensor $r_{lm}(n)$ is a sequence formed by filtering the reference signal x(n) by C which models the response of the $l^{th}$ sensor to the output of the $m^{th}$ secondary vibration source.

This requires each reference signal to be filtered by the C filter which has coefficients for all the paths between the secondary vibration sources and the sensors. So far, no consideration has been given to compensating for changes in the acoustic response of the system by modifying the C coefficients. This will now be discussed.

A noise source generates a random or pseudo-random noise signal s(n) which is preferably uncorrelated with the reference signal x(n). The noise signal is provided to the secondary vibration source to provide a low level white noise in the acoustic area of noise cancellation. The level of the noise is low and below that of the ambient noise within the acoustic region. The noise signal s(n) is also fast Fourier transformed to provide the spectral components $S_k$. The error signal e(n) from the error sensor will contain a contribution from the detection of the noise input by the secondary vibration sources from the noise signal s(n). Thus the error signal e(n) is fast Fourier transformed to provide the spectral components $E_k$. The Fourier transform $E_k$ of the error signals and the Fourier transform $S_k$ of the noise signal is then used to form a cross spectral estimate. The cross spectral estimate is then inverse fast Fourier transformed to form a cross correlation estimate. It is the cross correlation estimate which is used to modify the C filter coefficients. The cross correlation estimate can be multiplied by a convergence coefficient for the same reasons as those given above for the adaption of the w coefficients.

Thus for this arrangement the algorithm is given by $$\underline{C}(n+1)=\underline{C}(n)-\mu IFFT\,(\underline{S}^H{}_k\,\underline{E}_k)$$

where μ is a convergence coefficient $\underline{S}_k$ represents the vector of complex values of the Fourier transform of the noise signal at the $k^{th}$ iteration $\underline{E}_k$ represents a matrix of complex values of the Fourier transform of the error signals e(n) at the $k^{th}$ iteration H denotes the complex conjugate of the matrix IFFT denotes the inverse fast Fourier transform of the term in the brackets.

Alternatively, the cross spectral estimate can be multiplied by a convergence coefficient in order to reduce the effect of random errors on the adaption of the C filter coefficients. In this case the algorithm is given by:

$$\underline{C}(n+1)=\underline{C}(n)-IFFT(\mu\underline{S}^H{}_k\,\underline{E}_k)$$

The advantage of updating the C filter coefficients in the frequency domain by forming a cross spectral estimate is that only the C filter coefficients corresponding to frequencies away from the frequencies of the vibrations to be cancelled can be adapted if there is correlation between the noise signal s(n) and the reference signal x(n). This is of particular importance where the reference signal comprises only one or a low number of frequencies. In such an arrangement if adaption of the C filter coefficients at the frequency of adaptive cancellation took place then because of the likelihood of correlation between the noise signal s(n) and the reference signal x(n) erroneous values for the C filter coefficients are likely to be found and the system will become unstable. It is important that the noise signal s(n) is uncorrelated with the reference signal x(n) for the frequency components of the C matrix at which adaption is taking place. For instance, in a system for cancelling harmonics generated within a passenger compartment of a vehicle, as disclosed in WO88/02912 the system shown in FIG. 1 can adaptively learn the C filter coefficients at frequencies away from the frequencies at which adaptive cancellation is occurring, whilst simultaneously performing adaptive noise cancellation. As the engine frequency changes and hence the frequencies of the harmonics change then the C filter coefficients that were not updated at one engine speed will be updated as the engine speed changes. This allows for accurate modelling of the acoustic response within the passenger compartment which can change, such as by the opening of a window.

Figure 2:
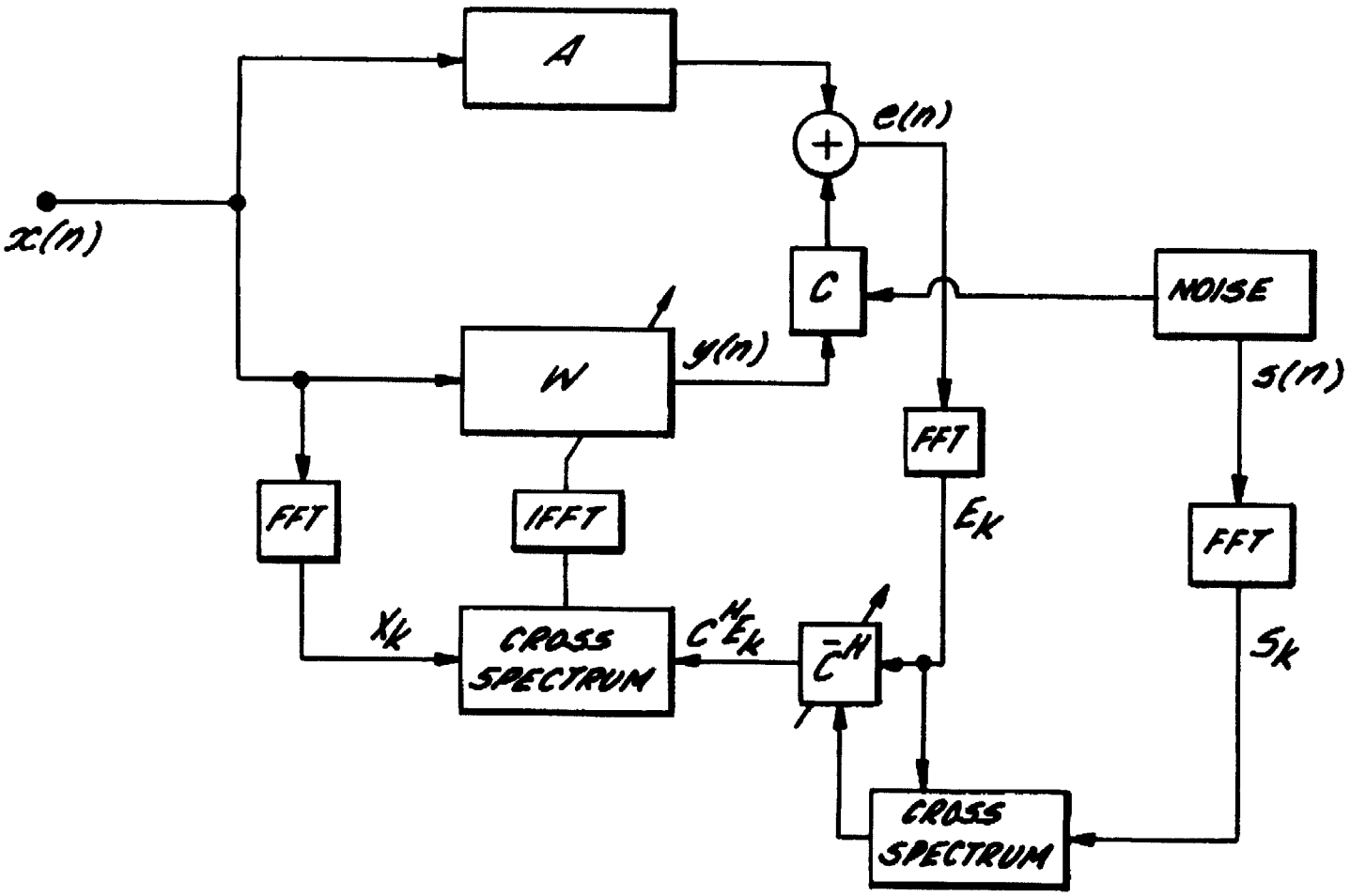
FIG. 2 illustrates schematically an adaptive control system wherein the adaption of the transfer functions of the acoustic system and the adaption of the filter coefficients for adaptive cancellation takes place in the frequency domain whilst adaption of the drive signal takes place in the time domain.

Referring now to FIG. 2, this illustrates an adaptive noise cancellation system wherein the coefficients of the w filter are updated in the frequency domain whilst the adaption of the drive signal y(n) takes place in the time domain. Since the adaption of the w coefficients takes place in the frequency domain, then compensation for the acoustic response of the system can also take place in the frequency domain. Thus the coefficients on the C filter are complex and the values of these complex filter coefficients are modified in the frequency domain.

The arrangement shown in FIG. 2 differs from that in FIG. 1 in that the fast Fourier transform of both the reference signal x(n) and the error signal e(n) is taken. This provides vectors of complex values representing amplitude and phase components of spectral components of the reference signal x(n) and error signal e(n). These are given by $X_k$ and $E_k$ respectively. To compensate for the acoustic response of the system the Fourier transform $E_k$ of the error signal is multiplied by the complex conjugate of the complex filter coefficients of the C filter. The result of this operation is then multiplied with the complex conjugate of the transform $X_k$ of the reference signal to form a cross spectral estimate. The inverse fast Fourier transform of the cross spectral estimate is then taken to form a cross correlation estimate. The causal part of the cross correlation estimate is then used to update the w filter coefficients. In order to increase the stability of the adaptive control system a convergence coefficient is multiplied either by the cross spectral estimate or the cross correlation estimate in order to smooth out the effect of random errors in the cross spectral estimate and cross correlation estimate respectively on the adaption. Thus the update algorithm for the adaptive control is given by:

$$\underline{w}(n+1)=\underline{w}(n)-\mu IFFT\,[\underline{X}^H{}_k\,(\underline{C}^H\,\underline{E}_k)]$$

or by $$\underline{w}(n+1)=\underline{w}(n)-IFFT\,[\mu\underline{X}^H{}_k\,(\underline{C}^H\,\underline{E}_k)]$$

where $\underline{X}_k$ represents a vector of complex values of the Fourier transform of the reference signal x(n) at the $k^{th}$ iteration, In the above equations the $\underline{C}$ matrix contains the transfer functions or a model of the amplitude and phase applied to each drive signal as detected by each sensor, whereas the conjugate of the $\underline{C}$ matrix represents a model of the amplitude and the inverse of the phase.

So far no consideration has been given to the modification of the complex C coefficients in the $\underline{C}$ matrix. This is achieved in the arrangement shown in FIG. 1 by inputting a white noise signal to the secondary vibration source to generate white noise within the acoustic area in which noise cancellation is taking place. Also, the noise signal s(n) is fast Fourier transformed to provide the amplitude and phase of the spectral components $S_k$. The Fourier transform $E_k$ of the error signal (which is already available) is then multiplied by the complex conjugate of the transform $S_k$ of the noise signal to provide a cross spectral estimate. The cross spectral estimate is then used to modify the coefficients of the $\underline{C}$ matrix from which the complex conjugate is calculated for multiplication with the transform $E_k$ of the error signal. The modification of the complex coefficients of the $\underline{C}$ matrix will be given by the following equation:

$$\underline{C}_{k+1}=\underline{C}_k-\mu\underline{S}^H_k\,\underline{E}_k$$

Figure 3:
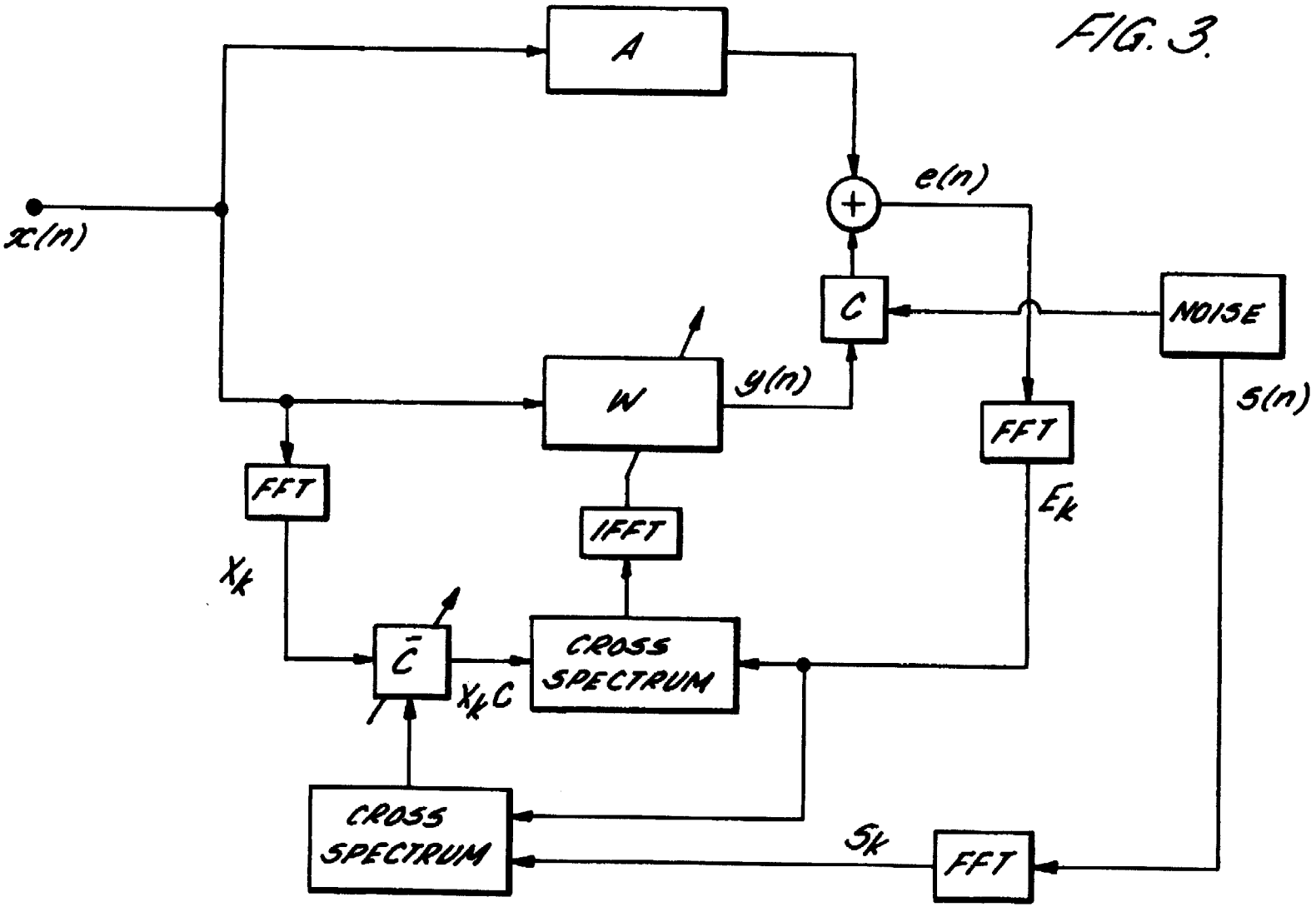
FIG. 3 illustrates schematically an alternative arrangement to FIG. 2 wherein the cross spectrum for adaptive control of the drive signal is formed using an alternative method.

FIG. 3 illustrates an alternative arrangement to that shown in FIG. 2. This arrangement only differs in that instead of multiplying the transform of $E_k$ of the error signal by the complex conjugate of the $\underline{C}$ matrix, the transform $X_k$ is multiplied by the $\underline{C}$ matrix.

The algorithm for the modification of the coefficients of the $\underline{C}$ matrix for the arrangement shown in FIG. 3 can be given by:

$$\underline{w}(n+1)=\underline{w}(n)-\mu IFFT\,[(\underline{CX}_k)^H\,\underline{E}_k]$$

or by $$\underline{w}(n+1)=\underline{w}(n)-IFFT\,[\mu(\underline{CX}_k)^H\,\underline{E}_k]$$

In this arrangement the modification of the coefficients of the $\underline{C}$ matrix is performed in the same manner as described hereinabove with reference to FIG. 2. FIGS. 2 and 3 represent alternative arrangements for forming the cross spectral estimate for adaption of the w coefficients. For a multichannel system where there are a number of reference signals x(n) the arrangement shown in FIG. 3 is less computationally efficient since each reference signal must undergo a modification by the $\underline{C}$ matrix.

Both the arrangements shown in FIGS. 2 and 3 enjoy the advantage of computational efficiency for the calculation of the updates of the w coefficients since the formation of the cross spectral estimate is achieved merely by multiplying the functions, whereas in the arrangement shown in FIG. 1 the formulation of the cross correlation estimate requires the convolving of the functions. Thus for a w filter having a reasonably large number of coefficients the arrangements shown in FIGS. 2 and 3 are far more computationally efficient. Further, for a multichannel system where there are a number of reference signals, secondary vibration sources and error sensors, the arrangement shown in FIG. 2 has the further advantage that each reference signal need not be multiplied by the $\underline{C}$ matrix, thus reducing the number of computations compared to the arrangement shown in FIG. 2 by a factor determined by the number of reference signals.

Further, computational saving is achieved by modifying the coefficients of the $\underline{C}$ matrix in the frequency domain, particularly when there are a large number of coefficients. As mentioned hereinabove, the formation of a cross spectral estimate merely involves multiplying the functions whereas the formation of a cross correlation estimate involves the convolving of functions. By using the frequency domain update of the w coefficients in the manner shown in FIGS. 2 and 3 the advantage of modifying the coefficients of the $\underline{C}$ matrix in the frequency domain can be fully realised since there is no need to inverse Fourier transform the cross spectral estimate. The cross spectral estimate can be used directly to modify the complex coefficients of the C filter compared with FIG. 1 where the inverse fast Fourier transform of the cross spectral estimate must be taken in order to form the cross correlation estimate which can then be used to modify the coefficients of the C filter in the time domain.

It is evident that the arrangement shown in FIG. 2 also enables the modification of the complex filter coefficients of the C filter to have frequencies away from the frequencies at which the adaptive w filter is working to reduce noise within the acoustic area. As mentioned hereinabove for the time domain this is important where the reference signal contains only a few harmonics and there is likely to be correlation between the reference signal x(n) and the noise signal s(n). Modification of the coefficients of the $\underline{C}$ matrix at frequencies which are correlated results in instability of the adaptive control system and is to be avoided.

Figure 4:
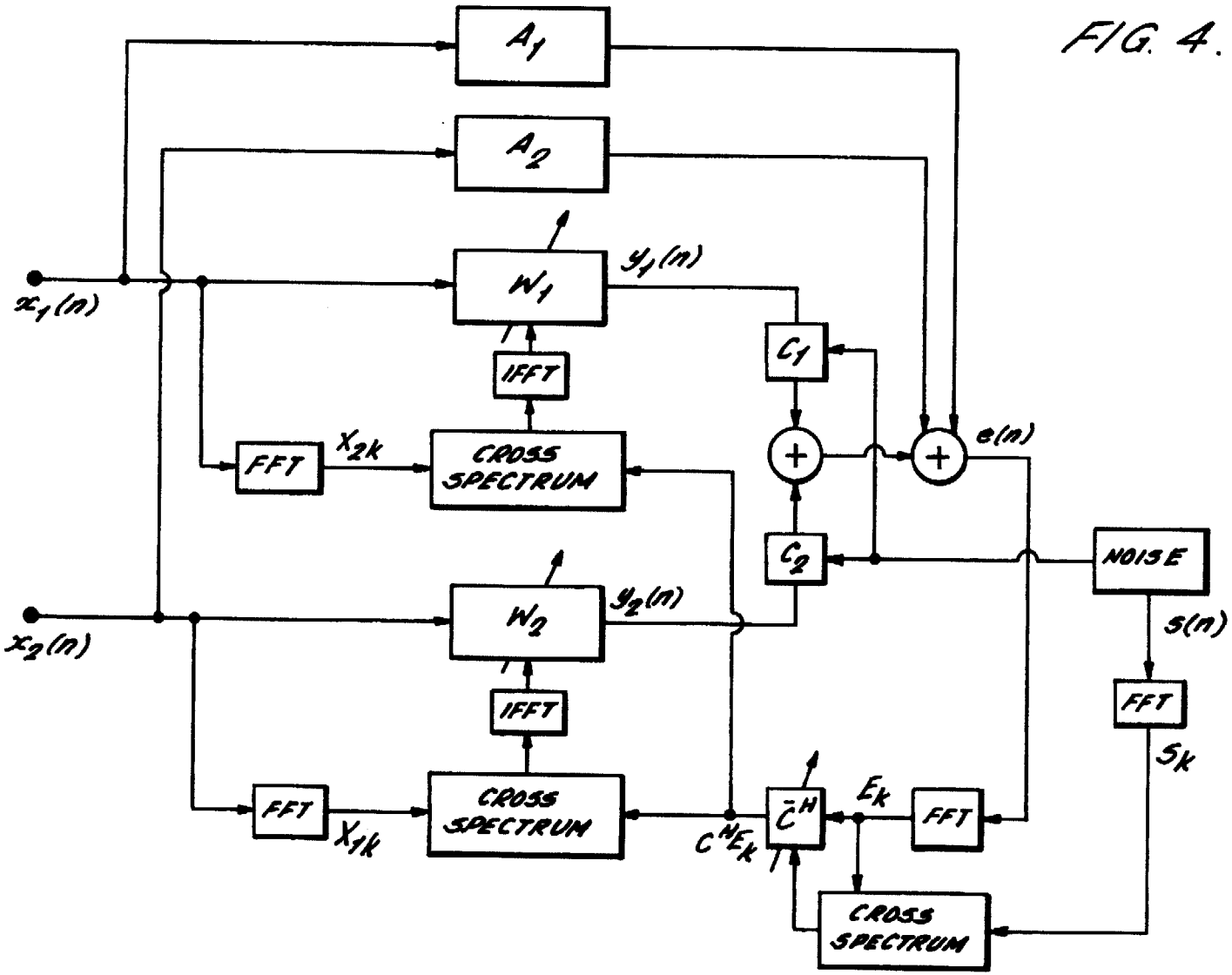
FIG. 4 illustrates an expansion of the arrangement shown in FIG. 2 for two reference signals.
Figure 5:
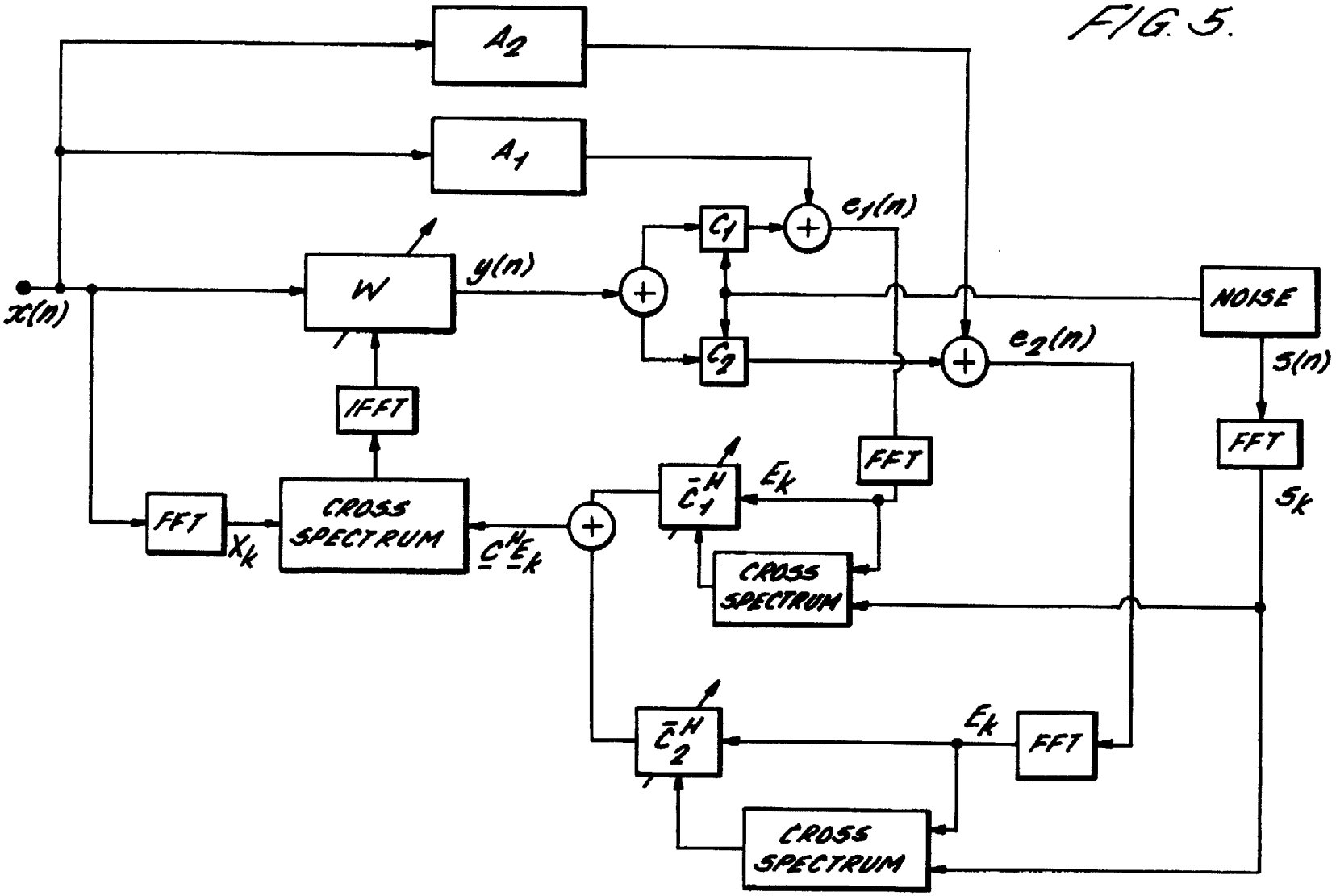
FIG. 5 illustrates an expansion of the arrangement shown in FIG. 2 for two error sensors.
Figure 6:
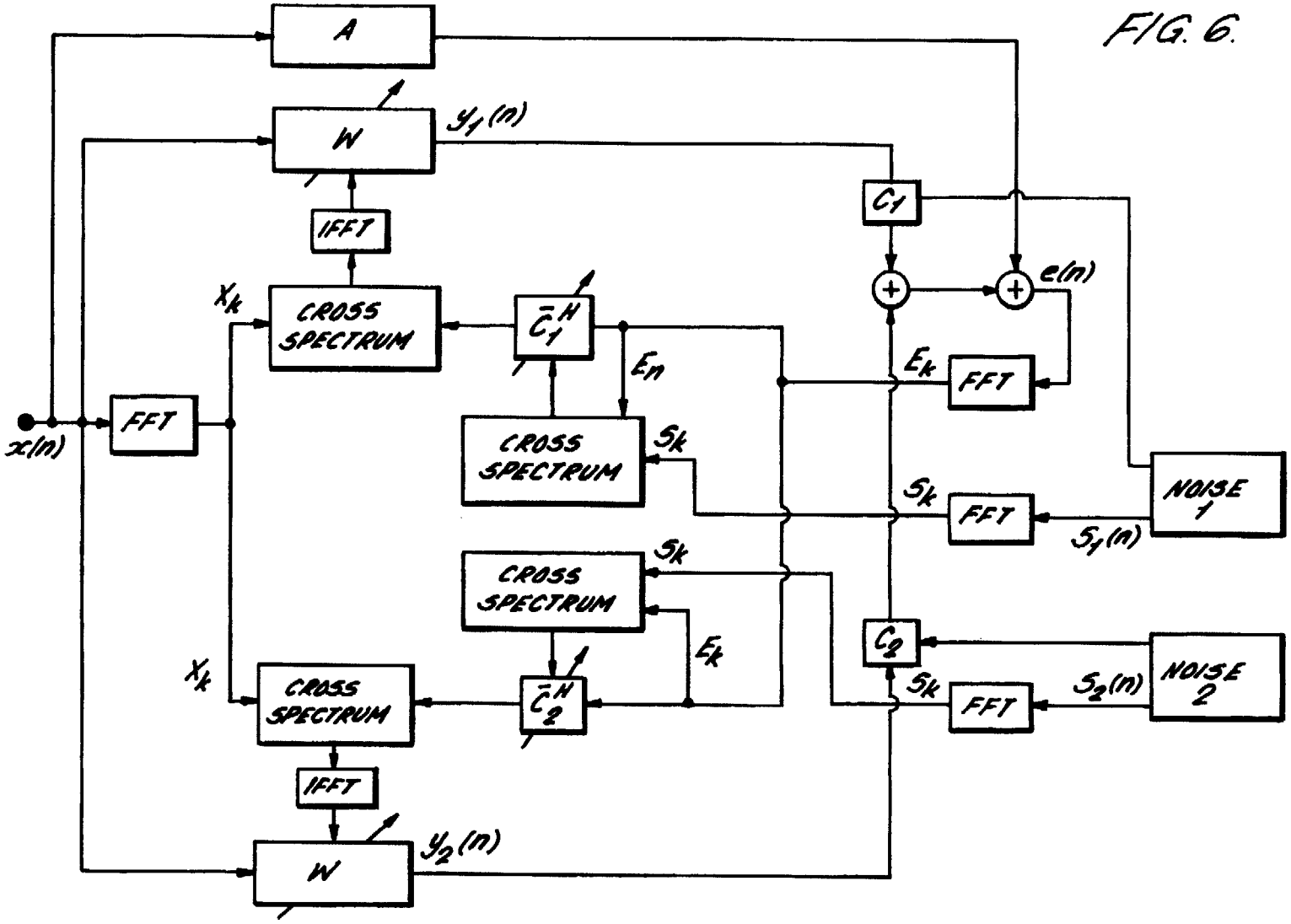
FIG. 6 illustrates an expansion of the arrangement shown in FIG. 2 for two secondary vibration sources.

FIGS. 4, 5 and 6 illustrate an expansion of the arrangement shown in FIG. 2 for a multichannel system. FIG. 4 illustrates a system having two reference signals $x_1(n)$ and $x_2(n)$. FIG. 5 illustrates an adaptive control system provided with two error sensors to provide two error signals $e_1(n)$ and $e_2(n)$. FIG. 6 illustrates an adaptive control system having two secondary vibration sources receiving two drive signals $y_1(n)$ and $y_2(n)$. A complete multichannel system will in fact comprise a number of reference signal error sensors and secondary vibration sources and can be built up from these arrangements as would be evident to a skilled person in the art.

In the multichannel system with a number of error sensors, the algorithm reduces the noise by reducing the sum of the mean of the square of the error signals in a similar manner to that disclosed in WO88/02912.

Although in the foregoing embodiments the modification of the C filter coefficients in the frequency domain has been illustrated with respect to the adaption of the drive signal in the time domain (either by updating the w filter coefficients in the time or frequency domain), the present invention is equally applicable to an active vibration control system which adapts the drive signal in the frequency domain. Such a system uses complex w filter coefficients and requires the reference signal to be transformed and the output drive signal to be inverse transformed.

In any of the foregoing embodiments the transform $S_k$ of the noise signal can be modified in order to keep the signal to noise ratio constant within the area of noise cancellation. The signal to noise ratio for the noise can be made less than the signal to noise ratio for the drive signal.

So far no consideration has been given to the practical problems of taking the Fourier transform of the continuous reference signal x(n), error signal e(n) and noise signal s(n). In order to perform a discrete fast Fourier transform a block or window of data must be stored and operated on. The number of data points which are required to enable adaption of the w filter coefficients must at least correspond to the delay associated with the adaptive response filter w since for a reference signal x(n) the effect upon the w filter presented in the error signal e(n) must be present. The number of data points which are required for the modification of the coefficients of the C filter must at least correspond to the delay associated with the acoustic delay within the system since for the noise signal s(n) the effect upon it by the acoustic response of the system which is presented in the error signal e(n) must be present.

Considering the situation with the modification of the C filter, if the block of noise data has a number n of data points for operation on by the fast Fourier transform then the $n^{th}$ data point will have a contribution in the error signal e(n) which is delayed by the acoustic delay (which is being modelled by the C filter and which corresponds to the length of the C filter). Thus if a time aligned window of error data e(n) is taken, the delayed contributions from the $n^{th}$ data point in the noise signal would not be measured. This reduces the possibility of accurately modelling the acoustic response to the system. This problem is overcome by taking a block or window of data having n data points where the last few p data points are set to zero. Thus the block of data has a length of 0 to n but only the data points 0 to n-p contain actual noise signal data. The number p of data points which are set to zero is dependent on the acoustic delay within the system. The number p should be set such that the time taken to sample p data points is at least as long as or longer than the acoustic delay in the system.

Figure 7:
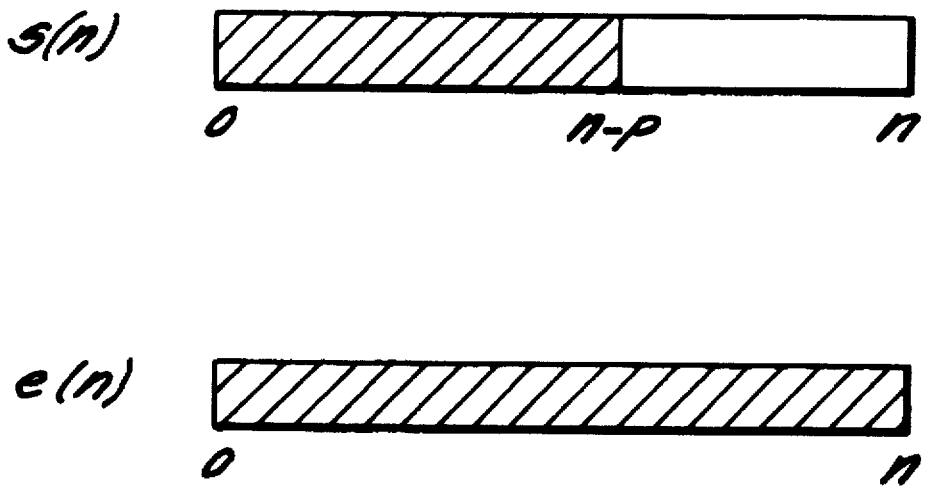
FIG. 7 illustrates the blocks of noise and error signal data used for the transform to form the cross spectral estimate.

Using this method assures that all contributions from the noise signal data point s(n-p) are contained within the error signal data block e(n) for the two time aligned blocks of data. FIG. 7 illustrates the two data blocks for the noise and error signals. These blocks of data are used for the fast Fourier transform and this method ensures that all contributions from the noise signal data points are found in the error signal data block.

The data blocks or windows represent "snap shots" in time of the noise and error signals. There is no requirement for these data blocks to be taken end to end. Blocks of data can be taken at intervals of time. If the intervals between the acquisition of the data blocks is large then clearly the modification of the coefficients of the C filter will be slow and the system will be slow to respond to changes in the acoustic response of the system. However, reducing the data acquisition greatly reduces the processing required. It is thus a trade off between providing rapid response to acoustic changes and minimising the processing requirements.

The above problems of providing sampled data are also encountered for the w filter. In an analogist manner to that used for the C filter a block of reference signal date x(n) is taken and a number p of data points are zero corresponding to the delay within the w filter to ensure that all contributions by the reference signal data block falls within the error signal data block.

Figure 8:
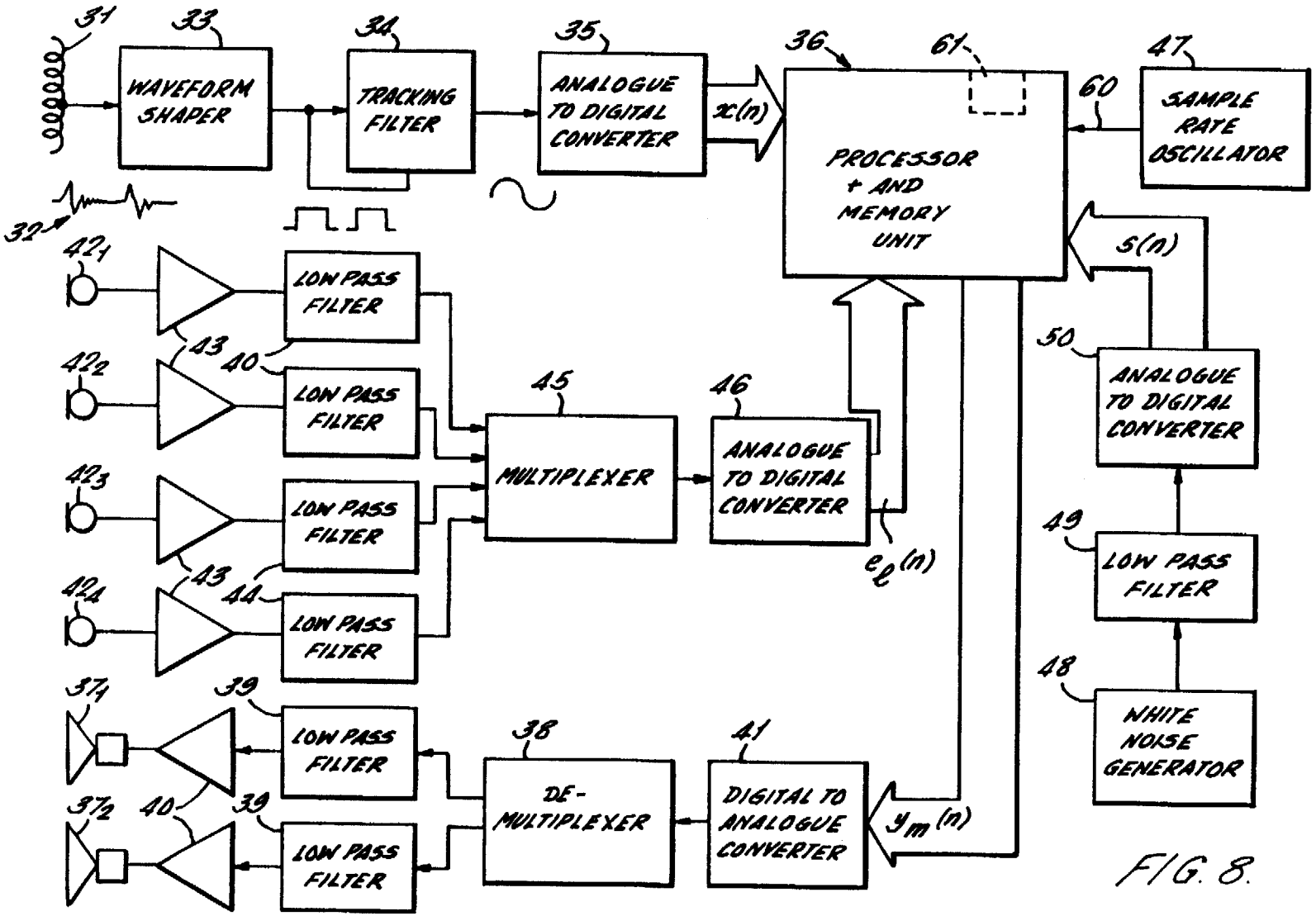
FIG. 8 is a schematic drawing of an active vibration control system for practical implementation.

FIG. 8 illustrates schematically the construction of an active vibration control system for use in a motor vehicle. In this arrangement there is shown a multichannel system having four error sensors in the form of microphones $42_1$ through $42_4$, two secondary vibration sources in the form of loudspeakers $37_1$ and $37_2$ and one reference signal x(n) formed from a signal 32, from the ignition coil 31 of the vehicle. In this arrangement the reference signal x(n) is formed from the ignition coil signal 32 by shaping the waveform in a waveform shaper 33 and using a tracking filter 34 to provide a sinusoidal waveform. This is then converted to a digital signal by the analogue to digital converter 35 for input to the processor 36. The processor 36 is provided with a memory 61 to store data as well as the program to control the operation of the processor 36. The signal 32 therefore provides a direct measure of the frequency of rotation of the engine and this can be used to generate harmonics within the processor, which harmonics are to be cancelled within the cabin of the vehicle.

The processor 36 generates a drive signal $y_m(n)$ which is converted to an analogue signal by the digital to analogue converter 41 and demultiplexed by the demultiplexer 38 for output through low pass filters 39 and amplifiers 40 to loudspeakers $37_1$ and $37_2$. This provides a secondary vibration within the vehicle cabin to cancel out vibrations generated by the primary source of vibration which comprises the engine. In the case of an engine, the rotation frequency comprises the primary frequency of vibration which has harmonics. It is these harmonics which are cancelled out within the vehicle cabin.

Microphones $42_1$ through $42_4$ detect the degree of success in cancelling the vibrations and provide error signals which are amplified by amplifiers 43, low pass filtered by low pass filters 44 and multiplexed by the multiplexer 45 before being digitally converted by the analogue to digital converter 46 to provide the error signal $e_l(n)$.

Thus the processor 36 is provided with a reference signal x(n), error signal el(n) and outputs a drive signal $y_m(n)$. The processor 36 is also provided with a constant sample rate 60 from a sample rate oscillator 47. This controls the sampling of the signals. The processor 36 is also provided with a noise signal s(n). A white noise generator 48 generates random or pseudo-random noise which preferably is uncorrelated with the reference signal x(n). This is passed through a low pass filter 49 and converted to a digital signal s(n) by the analogue to digital converter 50. Within the processor 36 the noise signal s(n). from the white noise generator is also added to the drive signal y(n) so that a low level noise signalis output from the loudspeakers 37 and 37. The noise signal s(n) is also processed by the processor 36 together with the error signal $e_l(n)$ in order to determine the coefficients of the $\underline{C}$ matrix as hereinbefore described.

The noise signal generator 48 in FIG. 3, although stated to be a white noise generator, can be any noise source which generates noise uncorrelated with the reference signal. Where only certain frequencies are being cancelled, the noise generator can generate noise at other frequencies to allow the modification of the $\underline{C}$ matrix entries (or C filter coefficients) at these frequencies. Such a noise source could provide a swept frequency signal for instance, such as a "chirp". However the use of white or random noise would appear the most desirable since this would be the least obtrusive to a person in the area of noise cancellation.

Although in FIG. 3 the digital converters 35 and 46 and the analogue to digital converter 41 are shown separately, such can be provided in a single chip. The processor receives a clock signal 60 from the sample rate oscillator and it thus operates at a fixed frequency related to the frequencies of the vibrations to be reduced only by the requirement to meet Nyquist's criterion. The processor 36 can be a fixed point processor such as the TMS 320 C50 processor available from Texas Instruments. Alternatively, the floating point processor TMS 320 C30 also available from Texas Instruments can be used to perform the algorithm.

Although the arrangement shown in FIG. 3 illustrates a system for cancelling engine noise wherein only a single reference signal is provided, the system can also be used for cancelling road noise where more than one reference signal is produced, such as vibrations from each wheel of the vehicle. Although in such a system vibrations from the wheels would normally comprise a broad range of frequencies, selected frequencies can be cancelled.

Further, although in FIG. 3 the secondary vibration sources illustrated as loudspeakers $37_1$ and $37_2$, the sources could alternatively be vibration actuators or a mix of loudspeakers and such actuators.

Although the foregoing embodiments of the invention have been described in relation to the cancellation of undesired acoustic vibrations, the present invention is not limited to the cancellation of acoustic vibrations and can equally be used for the cancellation or reduction of any undesired signals such as electrical signals in an electrical circuit, for example.

We claim:

1. An adaptive control system for reducing undesired signals comprising processing means adapted to provide at least one secondary signal to interfere with the undesired signals; and residual means to provide for said processing means at least one residual signal indicative of the interference between said undesired and secondary signals; wherein said processing means is adapted to use said at least one residual signal to adjust the or each secondary signal to reduce said at least one residual signal; wherein;

noise generation means is provided which adds at least one low level noise signal to said at least one secondary signal and provides said at least one low level noise signal to said processing means;

said processing means is adapted to transform said at least one low level noise signal and said at least one residual signal to provide the amplitude and phase of spectral components of said signals;

signal means is provided which provides at least one first signal indicative of at least selected undesired signals;

said processing means filters the at least one first signal indicative of at least selected undesired signals using adaptive response filter means having first and second filter coefficients;

said processing means adapts said first filter coefficients using the spectral components of said at least one low level noise signal and said at least one residual signal;

said processing means uses the first filter coefficients to filter one of the at least first signal indicative of at least selected undesired signals and the at least one residual signal;

said processing means adapts said second filter coefficients in response to the at least first signal indicative of at least selected undesired signals and the at least one residual signal, one of said signals having been filtered using the first filter coefficients;

said processing means in producing the at least one secondary signal uses the second filter coefficients to filter the at least first signal indicative of at least selected undesired signals; and the processing means adapts said first and second filter coefficients to reduce said at least one residual signal.

2. An adaptive control system as claimed in claim 1, wherein said processing means forms at least one cross spectral estimate using the transform of the at least one low level noise signal and the at least one residual signal and uses said at least one cross spectral estimate to adapt said first filter coefficients.

3. An adaptive control system as claimed in claim 2, wherein said processing means is adapted to form said at least one cross spectral estimate by multiplying the complex conjugate of the transform of said low level noise signal with the transform of said at least one residual signal.

4. An adaptive control system as claimed in claim 2, wherein said processing means is adapted to multiply said at least one cross spectral estimate with a convergence coefficient sufficiently small to smooth out the effect of random errors in the cross spectral estimate on the modification of the first filter coefficients.

5. An adaptive control system as claimed claim 2, wherein said fast filter coefficients are complex and said processing means is adapted to modify said complex first filter coefficients.

6. An adaptive control system as claimed in claim 2, wherein said processing means is adapted to inverse transform said at least one cross spectral estimate to form at least one cross correlation estimate, and to modify said first filter coefficients using said at least one cross correlation estimate.

7. An adaptive control system as claimed in claim 6, wherein said processing means is adapted to multiply said at least one cross correlation estimate with a convergence coefficient sufficiently small to smooth out the effect of random errors in the cross correlation estimate on the modification of said first filter coefficients.

8. An adaptive control system as claimed in claim 5, wherein said processing means is adapted to transform said at least one first signal, to form at least one second cross spectral estimate using the transform of said at least one first signal and the transform of said at least one residual signal, to inverse transform said at least one second cross spectral estimate to form at least one second cross correlation estimate, and to modify said second filter coefficients using said at least one second cross correlation estimate.

9. An adaptive control system as claimed in claim 8, wherein said processing means is adapted to form at least one second cross spectral estimate by filtering the transform of said at least one first signal using said complex first filter coefficients and multiplying the complex conjugate of the result with the transform of said at least one residual signal.

10. An adaptive control system as claimed in claim 8, wherein said processing means is adapted to form at least one second cross spectral estimate by filtering the transform of said at least one residual signal using the complex conjugate of said complex first filter coefficients and multiplying the result with the complex conjugate of the transform of said at least one first signal.

11. An adaptive control system as claimed in claim 1, for reducing selected signals of said undesired signals, wherein said processing means is adapted to only modify the first filter coefficients which do not adjust said at least one secondary signal at the frequency of said selected signals.

12. An adaptive control system as claimed in claim 1 wherein said noise generation means is adapted to generate random or pseudo-random noise.

13. An adaptive control system as claimed in claim 1 wherein said noise generation means is adapted to generate noise uncorrelated at least with selected signals of said undesired signals.

14. An adaptive control system as claimed in claim 1 wherein said processing means is adapted to modify at least one of the amplitude and phase of the spectral components of said noise signal, and to inverse transform the modified spectral components for addition to said at least one secondary signal.

15. An adaptive control system as claimed in claim 1 wherein said processing means is adapted to digitally sample said noise signal and said at least one residual signal, and to store a plurality of digits for each said signal to form noise signal and residual signal data blocks respectively, said noise signal data blocks and said residual signal data blocks being time aligned; said processing means being further adapted to set a number of said digits at the end of each noise signal data block to zero to form a modified noise signal data block, and to transform the modified noise signal data block and the time associated residual signal data block to provide the amplitude and phase of spectral components of the digitally sampled signals.

16. An adaptive control system as claimed in claim 15, wherein said processing means is adapted to set the number of said digits at the end of each modified noise signal data block to zero in dependence on the delay between the noise signal and the contribution from the noise signal in the residual signal.

17. An adaptive control system as claimed in claim 16, wherein said processing means is adapted to select the number of digits to set to zero such that the time taken to sample said number is greater than the delay between a secondary signal and the contribution of the secondary signal in any residual signal.

18. An adaptive control system as claimed in claim 1 wherein said processing means is adapted to modify said signal filter coefficients to reduce a cost function.

19. A method as claimed in claim 18, wherein said second filter coefficients are modified to reduce a cost function.

20. An adaptive control system as claimed in claim 1, wherein the undesired signals are undesired acoustic vibrations, said system including at least one secondary vibration source adapted to receive said at least one secondary signal and generate secondary vibrations to interefere with said undesired vibrations; said residual means comprising at least one sensor means adapted to sense the residual vibrations resulting from the interference between said secondary and undesired vibrations, and to provide said at least one residual signal.

21. A method of actively reducing undesired signals comprising the steps of:

providing at least one secondary signal which interferes with said undesired signals;

providing at least one residual signal indicative of the interference between said undesired and secondary signals;

adjusting the or each secondary signal using said at least one residual signal to reduce the or each residual signal;

generating at least one low level noise signal;

adding said at least one low level noise signal to said at least one secondary signal;

transforming said at least one low level noise signal and said at least one residual signal to provide the amplitude and phase of spectral components of said signals;

providing at least one first signal indicative of at least selected undesired signals;

filtering the at least one first signal indicative of at least selected undesired signals using adaptive response filter means having adaptable first and second filter coefficients;

adapting the first filter coefficients using said spectral components of said at least one low level noise signal and said at least one residual signal;

filtering one of said at least one first signal indicative of at least selected undesired signals and said at least one residual signal using the first filter coefficients;

adapting the second filter coefficients in response to said at least one first signal indicative of at least selected undesired signals and said at least one residual signal after having filtered one of said signals using the first filter coefficients;

filtering the at least one first signal indicative of at least selected undesired signals using the second filter coefficients in the production of the at least one secondary signal; and adapting said first and second filter coefficients to reduce said at least one residual signal.

22. A method as claimed in claim 21, including the steps of forming at least one cross spectral estimate using the transforms of the at least one noise signal and the at least one residual signal; and adapting said first filter coefficients using said at least one cross spectral estimate.

23. A method as claimed in claim 22, wherein said at least one cross spectral estimate is formed by multiplying the complex conjugate of the transform of said at least one noise signal with the transform of said at least one residual signal.

24. A method as claimed in claim 22, including the step of multiplying said at least one cross spectral estimate with a convergence coefficient sufficiently small to smooth out the effect of random errors in the cross spectral estimate on the modification of the first filter coefficients.

25. A method as claimed in claim 22, wherein said first filter coefficients are complex and said complex first filter coefficients are modified using said at least one cross spectral estimate.

26. A method as claimed in claim 22, including the steps of inverse transforming said at least one cross spectral estimate to form at least one cross correlation estimate, and modifying said first filter coefficients using said at least one cross correlation estimate.

27. A method as claimed in claim 26, including the step of multiplying said at least one cross correlation estimate with a convergence coefficient sufficiently small to smooth out the effect of random errors in the cross correlation estimate on the modification of said first filter coefficient.

28. A method as claimed in claim 25, including the steps of transforming said at least one first signal, forming at least one second cross spectral estimate using the transform of said at least one first signal and the transform of said at least one residual signal, inverse transforming said at least one second cross spectral estimate to form at least one second cross correlation estimate, and modifying said second filter coefficients using said at least one second cross correlation estimate.

29. A method as claimed in claim 28, wherein said at least one second cross spectral estimate is formed by filtering the transform of said at least one first signal using said complex first filter coefficients, and multiplying the complex conjugate of the result with the transform of said at least one residual signal.

30. A method as claimed in claim 28, wherein said at least one second cross spectral estimate is formed by filtering the transform of said at least one residual signal using the complex conjugate of said complex first filter coefficients, and multiplying the result with the complex conjugate of the transform of said at least one first signal.

31. A method as claimed in claim 21 for reducing selected signals of undesired signals wherein only the first filter coefficients which do not adjust said at least one secondary signal at the frequency of said selected signals are modified.

32. A method as claimed in claim 21, wherein the step of generating a low level noise signal comprises generating a low level random or pseudo-random noise signal.

33. A method as claimed in claim 21, wherein the step of generating a low level noise signal comprises generating a low level noise signal uncorrelated at least with selected signals of said undesired signals.

34. A method as claimed in claim 21, including the steps of modifying at least one of the amplitude and phase of the spectral components of said noise signal, and inverse transforming the modified spectral components for addition to said at least one secondary signal.

35. A method as claimed in claim 21, including the steps of digitally sampling said noise signal and said at least one residual signal, storing a plurality of digits for each said signal to form noise signal and residual signal data blocks respectively, said noise signal data blocks and said residual signal data blocks being time aligned; setting a number of said digits at the end of each noise signal data block to zero to form a modified noise signal data block; and transforming the modified noise signal data block and the time associated residual signal data block to provide the amplitude and phase of the digitally sampled signals.

36. A method as claimed in claim 35, wherein the number of digits set to zero is determined in dependence on the delay between the noise signal and the contribution from the noise signal in the residual signal.

37. A method as claimed in claim 36, wherein the number of said digits that are set to zero is determined such that the time taken to sample said number of digits is greater than the delay between a secondary signal and the contribution of the secondary signal in any residual signal.

38. A method as claimed in claim 21, wherein said undesired signals comprise undesired acoustic vibrations, the method including the steps of generating at least one secondary vibration from said at least one secondary signal, allowing said at least one secondary vibration and said undesired vibrations to interfere, and sensing residual vibrations resulting from the interference to provide said at least one residual signal.

* * * * *